US006631788B2

(12) United States Patent
Shikai et al.

(10) Patent No.: US 6,631,788 B2
(45) Date of Patent: Oct. 14, 2003

(54) ELEVATOR SYSTEM WITH SAFETY INSTALLATION

(75) Inventors: Masahiro Shikai, Tokyo (JP); Hajime Nakajima, Tokyo (JP); Toshiro Nakashima, Tokyo (JP); Kazuo Takashima, Tokyo (JP); Tatsushi Takahashi, Tokyo (JP); Shigeki Yamakawa, Tokyo (JP); Takeshi Fujiki, Tokyo (JP); Kunikazu Koura, Tokyo (JP); Koichi Nanno, Tokyo (JP); Shigeru Abe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/094,993

(22) Filed: Mar. 12, 2002

(65) Prior Publication Data

US 2002/0125077 A1 Sep. 12, 2002

(30) Foreign Application Priority Data

Mar. 12, 2001 (JP) ..... P2001-068445

(51) Int. Cl.[7] ..... B66B 13/14
(52) U.S. Cl. ..... 187/316; 49/26
(58) Field of Search ..... 187/316, 317, 187/414; 49/26, 25, 28, 27; 318/466–470

(56) References Cited

U.S. PATENT DOCUMENTS

| | | | | |
|---|---|---|---|---|
| 3,783,977 A | | 1/1974 | Vosser | |
| 4,621,452 A | * | 11/1986 | Deeg | 49/28 |
| RE33,668 E | * | 8/1991 | Gray | 250/221 |
| 5,284,225 A | * | 2/1994 | Platt | 187/316 |
| 5,329,075 A | | 7/1994 | Hirabayashi et al. | |
| 5,420,430 A | * | 5/1995 | Trett | 250/341.1 |
| 5,698,824 A | * | 12/1997 | Platt | 187/317 |
| 5,886,307 A | * | 3/1999 | Full et al. | 187/317 |

FOREIGN PATENT DOCUMENTS

| | | |
|---|---|---|
| JP | 63-66084 | 3/1988 |
| JP | 11-310375 | 11/1999 |

* cited by examiner

*Primary Examiner*—Jonathan Salata
(74) *Attorney, Agent, or Firm*—Leydig, Voit & Mayer, Ltd.

(57) ABSTRACT

An elevator system has a pair of horizontally opposed vertical surfaces defining therebetween a doorway or opening to an elevator cage and a door moving horizontally to open and close the opening. In particular, the system has a first optical device having a light emitter for emitting light and a second optical device having a light receiver for receiving the light emitted from the light emitter. The first and second optical devices are positioned in a vertical plane crossing the opening and adjacent to the opening. One of the first and second optical devices is positioned below the other of the first and second optical devices and mounted in the vertical surface.

12 Claims, 24 Drawing Sheets

ELEVATOR SYSTEM WITH SAFETY INSTALLATION

FIELD OF THE INVENTION

The present invention relates to an elevator system with a safety installation.

BACKGROUND OF THE INVENTION

There have been disclosed various elevator systems each equipped with a safety installation for preventing any member such as clothes from being drawn into a small gap defined between a slide door and a fixed wall adjacent to the door when the door opens a doorway into or out of an elevator cage. Among others, the Japanese Patent Publication No. 63-66084 (A) discloses such safety system, in which a vertical recess is formed at a vertically extending corner edge between one vertical wall defining the doorway and the other vertical wall adjacent to the opening/closing door. A pair of light emitter and receiver are provided at top and bottom portions of the vertical recess in order to detect any member such as clothes positioned near the gap between the opening/closing door and the adjacent fixed wall and, if detected, prohibit the opening operation of the door.

Also, the Japanese Patent Publication No. 11-310375 (A) discloses another safety installation, which includes a pair of light emitter and receiver positioned on a vertical line within a small gap or space define between the opening/closing door and the adjacent fixed wall for the detection of any member which has been drawn into the space.

The safety installations, however, have respective drawbacks. For example, according to the former safety installation, dust or foreign matters are retained at the bottom of the vertical recess, which results in a false detection of the member. On the other hand, the latter safety installation is capable of detecting any member already existing in the gap, but it is incapable of detecting any member which may be drawn into the gap.

SUMMARY OF THE INVENTION

Accordingly, an elevator system of the present invention has a pair of horizontally opposed vertical surfaces defining therebetween a doorway or opening to an elevator cage and a door moving horizontally to open and close the opening. In particular, the system has a first optical device having a light emitter for emitting light and a second optical device having a light receiver for receiving the light emitted from the light emitter. The first and second optical devices are positioned in a vertical plane crossing the opening and adjacent to the opening. Also, one of the first and second optical devices is positioned below the other of the first and second optical devices and mounted in the vertical surface.

DETAILED DESCRIPTION OF THE PREFERRED EMBODIMENTS

With reference to the drawings, several embodiments of the present invention will be described hereinafter. It should be understood that the present application is based upon the Japanese patent Application No. 2001-068445, the disclosure of which being incorporated herein in its entirety by reference.

First Embodiment

Figure 1:
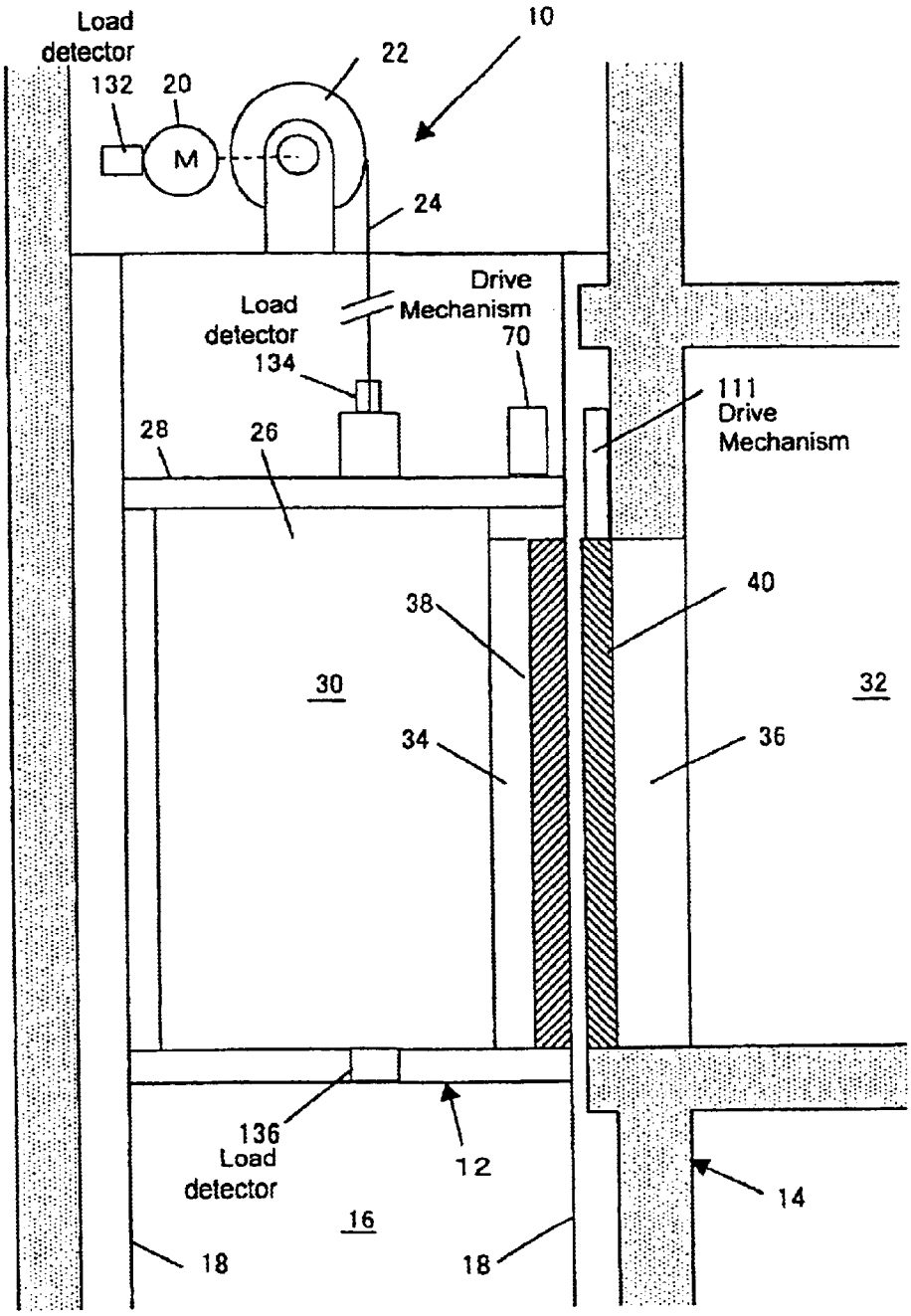
FIG. 1 is a schematic elevation view of an elevator system with a safety installation of the present invention.

Referring to FIG. 1, there is shown an elevator system generally indicated by reference numeral 10. The elevator system 10 includes an elevating member 12 elevating within a vertical shaft 16 constructed in a building 14 as it is guided by a plurality of vertical guide rails 18 extending on opposite side walls defining in part the shaft 16. A wire-winding device 22 with a driving motor 20 is secured at the top of the shaft 16. A wire 24 is wound at its one end around a drum of the wire-winding device 22 (not shown) and connected at its opposite end with the elevating member 12. This causes, by the driving of the motor 24 of the wire-winding device 22, the elevating member 12 to move up and down within the shaft 16.

The elevating member 12 has an elevator cage 26 defining therein a room for the transportation of the passengers and cargoes and a frame 28 provided around the cage 26 for the structural reinforcement of the cage. For the connection and disconnection between the room 30 defined within the cage 26 and each hall 32 of the building, a cage door system 38 is provided at a doorway (i.e., opening) of the cage 26 and a hall door system 40 is provided at each doorway (i.e., opening) of the hall 32.

Figure 2:
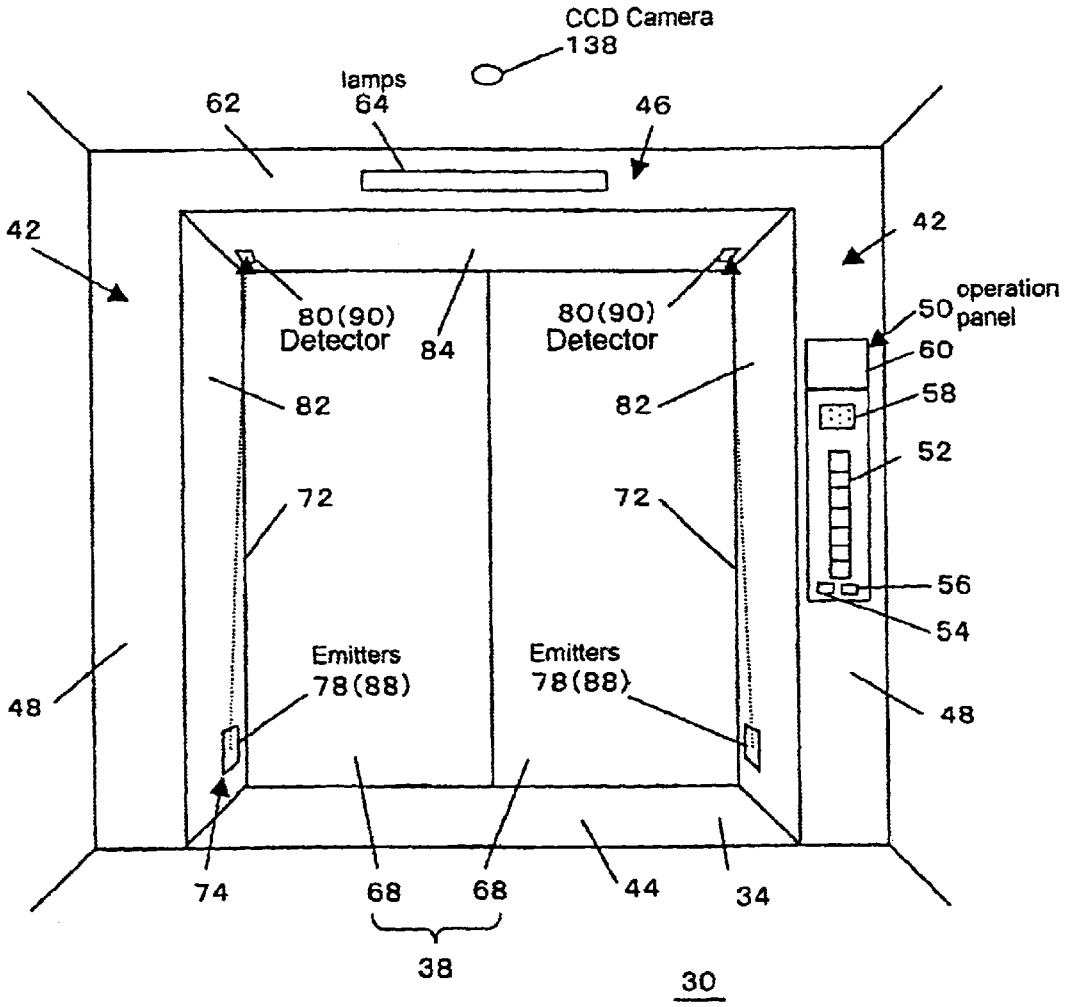
FIG. 2 is a side view of a cage entrance the elevator system when viewed from inside.

As shown in FIG. 2, the doorway 34 of the cage 26 is defined within a rectangular frame. The frame includes left and right vertical frame portions 42, lower horizontal frame portion 44 connecting between the lowermost ends of the vertical frame portions 42, and upper horizontal frame portion 46 connecting between the uppermost ends of the vertical frames 42. One of the vertical frame portions 42 has a front vertical wall 48 defining in part the room 30 and equipped with an operation panel 50. The operation panel 50 bears hall designation buttons 52, opening button 54, closing button 56, warning device 58 and display device 60. The upper horizontal frame 46 supports in its front wall a indication lamps 64 for the indication of the position of the cage 26 within the shaft 16.

Figure 4:
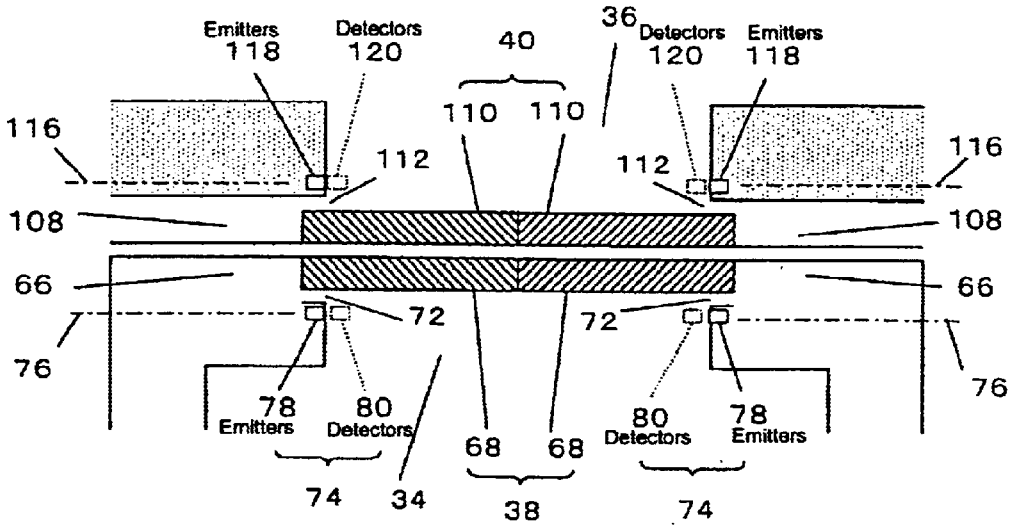
FIG. 4 is a schematic horizontal cross sectional view of the cage and hall entrances of the elevator system, in which the doors are closed.
Figure 5:
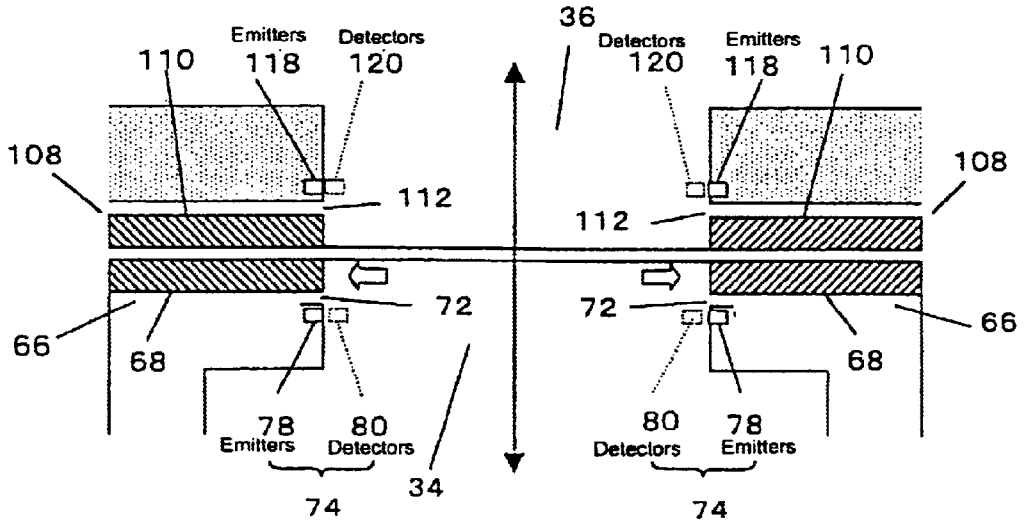
FIG. 5 is a schematic horizontal cross sectional view of the cage and hall entrances of the elevator system, in which the doors are opened;.

The door system 38 is a double-leaf door with two door portions or leaves 68, each protruding from leaf chambers 66 defined behind the left and right vertical frames 42 (see FIGS. 4 and 5) into the doorway 34. Each door leaf 68 is drivingly connected with a drive mechanism 70 (see FIG. 1) provided at a certain position of the cage 26 so that it moves between a closing position (extracted position) and an opening position (retracted position). In the closing position, a leading vertical end surface of one door leaf contacts with the opposing leading vertical end surface of the other door leaf to close the doorway 34. In the opening position, on the other hand, each of the door leaves 68 is fully received within the associated leaf chamber 66.

Preferably used for the drive mechanism 70 is one disclosed in the U.S. Pat. No. 3,783,977, which is equipped with an electric motor and a mechanism for changing a rotation generated by the motor into a translation of the door leaves and incorporated herein in its entirety by reference.

Referring back to FIG. 2, the elevator cage 26 is provided with a safety installation 74 in order to prevent any member such as clothes from being drawn into the gap 72 defined between the vertical frame 42 and the opening door leaf 38. For this purpose, the safety installation 74 has a first optical device 78 and a second optical device 80 in a vertical plane crossing the doorway 34 (indicated by an imaginary line 76 in FIG. 4). The first optical device 78 is mounted in and flush with the opposing vertical surfaces 82 of the frame defining the left and right ends of the doorway 34. Also, the second optical device 80 is mounted in and flush with the upper horizontal surface 84 of the frame defining the upper end of the doorway 34. In this embodiment, a light emitter 88 is used for the first optical device 78 and a light receiver 90 is used for the second optical device 80 so that light emitted from the light emitter 88 is received by the light receiver 90.

In order to detect any member which would exist near the gap 72, the first optical device 78 is provided adjacent to the lowermost end of the vertical surface 82 of the frame, preferably about 10–30 cm away from the lowermost end of the vertical surface 82. The second optical device 80 is provided adjacent to the left/light ends of the upper horizontal surface 84 of the frame, preferably about 5–20 cm away from the uppermost end of the vertical surface 82. Also preferably, the first and second optical devices.78 and 80 are mounted as close to the gap 72 as possible for the detection of any member adjacent to the gap 72.

As described above, the first and second optical devices 78 and 80 are used to optically detect any member possibly existing adjacent to the gap 72. Therefore, so far as it could detect the member, the light emitted from the light emitter may be visible or invisible and is not limited to that having a specific wavelength.

Another featuring structure of the safety installation 74 of the present invention is that a surface of the light emitter 88 facing to the doorway 34 is substantially flush with the vertical surface 82 of the frame. Preferably, the light receiver 90 is also substantially flush with the upper horizontal surface 46. This prevents the light emitter 88 and light receiver 90 from being damaged by the contacts with cargoes moving past the doorway 34. Also, a surface of the light receiver 90 through which light is received is faced downward so that substantially no dust would adhere thereto. Further, a surface of the light emitter 88 through which light is emitted is oriented vertically so that substantially no dust would adhere thereto.

Figure 3:
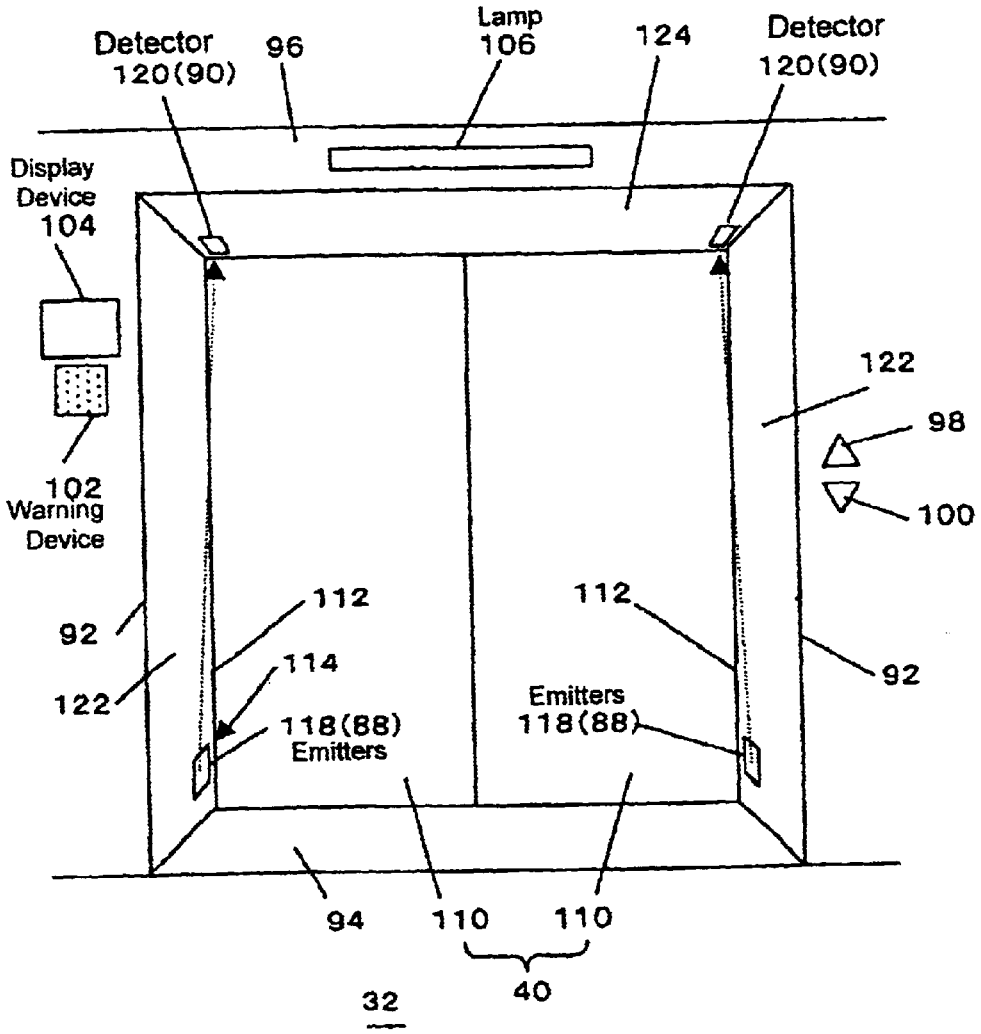
FIG. 3 is a side view of a hall entrance of the elevator system when viewed from a hall.

Referring next to FIG. 3, another doorway or opening 36 of each hall of the building is defined within a rectangular frame. The frame includes left and right vertical frame portions (vertical walls) 92, lower horizontal frame portion (floor wall) 94 connecting between the lowermost ends of the vertical frame portions 92, and upper horizontal frame portion 96 connecting between the uppermost ends of the vertical frames 92. In addition, left or/and right vertical wall portions of the doorway 36 support an upward hall button 98, downward hall button 100, warning device 102 and display device 104. Also, the upper horizontal frame 96 supports an indicator or lamp 106 indicating the position of the cage 26 within the shaft 16.

The hall door system 40 is also a double-leaf door with two door portions or leaves 110 each protruding from leaf chambers 108 defined behind the left and right vertical frames 92 (see FIGS. 4 and 5) into the doorway 36. The left and right door leaves 110 are mechanically connected with a drive mechanism 111 (see FIG. 1) for opening/closing the hall door leaves. The drive mechanism 111 is so designed that, when the cage 26 arrives at the hall 32, it engages with the associated drive mechanism 70 mounted on the cage 26. This causes the hall door 40 to operate between the closed position shown in FIG. 3 and the opened position shown in FIG. 4, in synchronism with the opening and closing operation of the cage door 38.

The hall 32 also has two sets of safety installation 114, similar to that for cage 26, provided on opposite sides of the doorway 36 to prevent any member such as clothes from being drawn into a gap 112 between the vertical frame 92 and the adjacent opening door leaf 110. The safety installation 114 includes a first optical device 118 and a second optical device 120 in a vertical plane (indicated by an imaginary line 116 in FIG. 3) crossing the doorway 36. The first optical device 118 is mounted in the vertical surfaces 122 of the frame defining the left and right ends of the doorway 36. The second optical device 120 is mounted in the upper horizontal surface 124 of the frame defining the upper end of the entrance 36. In this embodiment, the first and second optical devices 118 and 120 have light emitter 88 and light receiver 90, respectively, so that light from the emitter 88 is received by the receiver 90.

The first light optical device 118 is provided adjacent to the lowermost end of the vertical surface 122, preferably about 10–30 cm away from the lowermost end of the vertical surface 122. The second optical device 120 is provided adjacent to the left/light ends of the upper horizontal surface 124, preferably about 5–20 cm away from the uppermost end of the vertical surface 122. Also preferably, the first and second optical devices 118 and 120 are mounted as close to the gap 112 as possible, i.e., adjacent to the elevator shaft.

Also in the safety installation 114 of the hall 32, the light emitting surface of the light emitter 88 is substantially flush with the vertical surface 122, and the light receiving surface of the light receiver 90 is substantially flush with the horizontal surface 124. This prevents not only the light emitters 88 and light receivers 90 from being damaged by the possible contacts with cargoes but also surfaces of the light emitters and receivers from being covered with dust.

Figure 6:
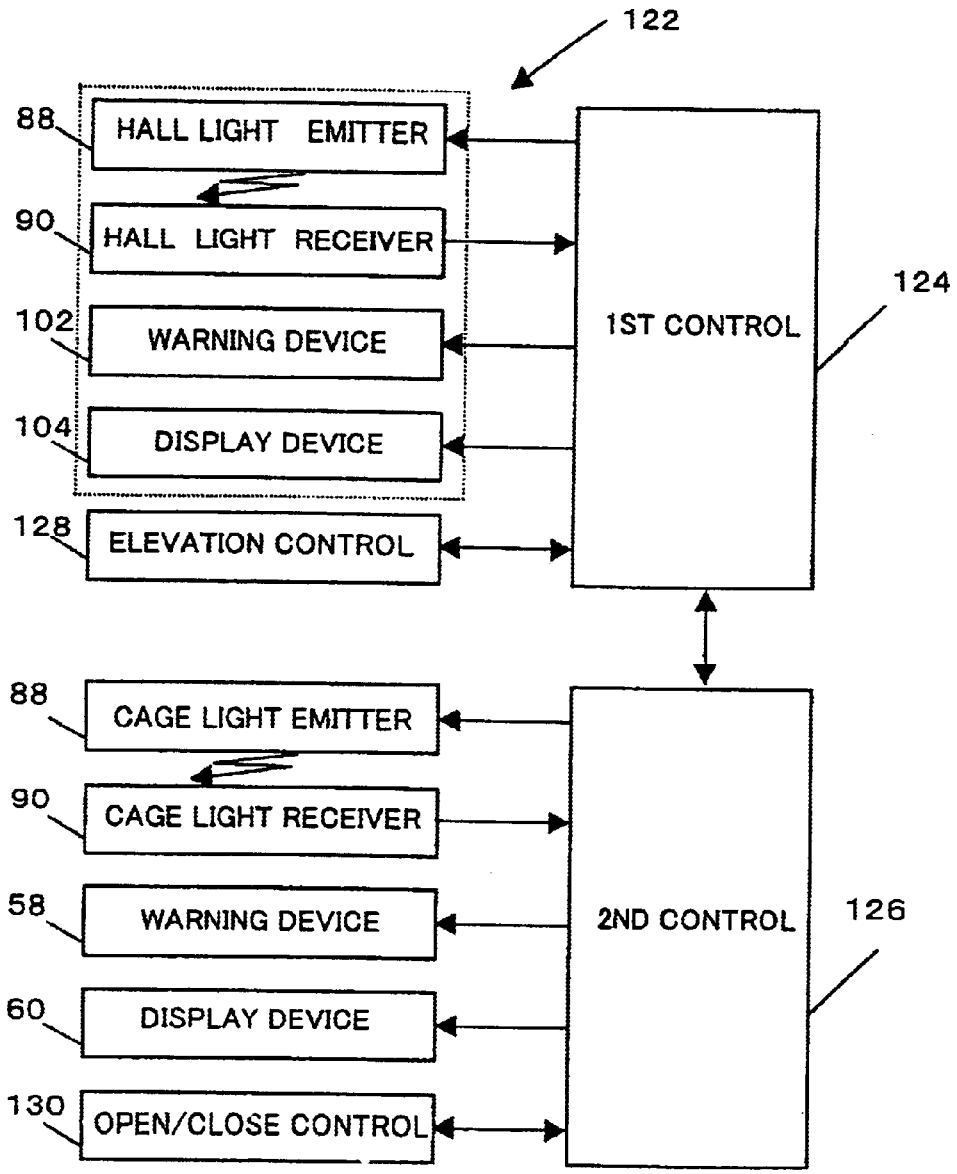
FIG. 6 is a block diagram of a control circuit of the safety installation of the elevator system.

FIG. 6 shows a control circuit 122 for the safety installations 74 and 114. In general, the control circuit 122 includes a first control (central control) 124 for controlling various parts or devices mounted, in particular, in the building and a second control (cage control) 126 for controlling various parts and devices mounted on the cages 26. The first and second controls 124 and 126 are electrically communicated with each other. The first control 124 is connected with the light emitter 88, light receiver 90, warning device 102 and display device 104 provided for each hall 32 and an elevation control 128 for controlling the motor 20. The second control 126 is connected with the light emitter 88, light receiver 90, warning device 58 and display device 69 provided for each cage 26 and a door opening/closing control 130 for controlling the drive mechanism 70.

Figure 7:
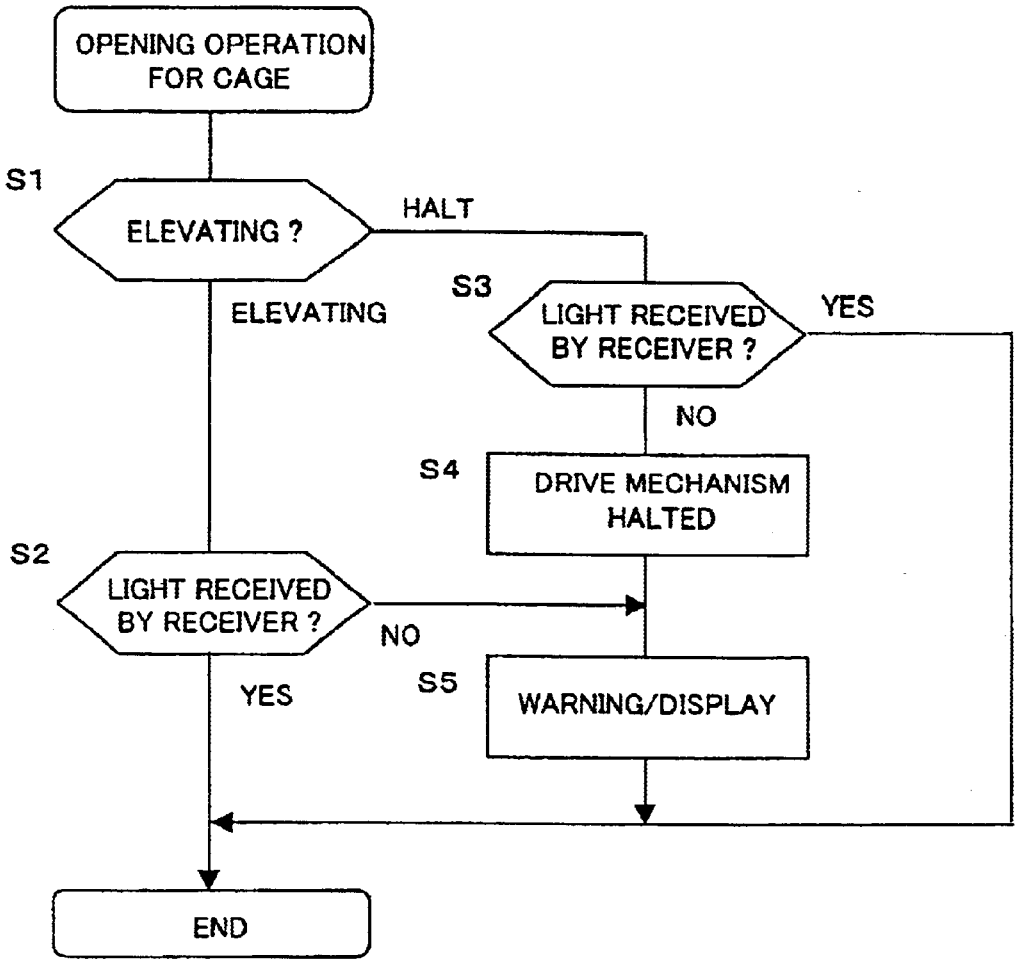
FIG. 7 is a flowchart showing a door opening operation of the safety installation for the cage.

FIG. 7 shows a flowchart showing the control operation of the second control 126 for the cage safety installation 74. According to this operation, at step S1 the second control 126 determines whether the associated cage 26 is currently moving up or down within the elevator shaft 16. The determination is performed using a signal transmitted from the first control 124 to the second control 126 for controlling the elevation of the cage 26. If the cage 26 is In the elevating operation, at step S2 the second control 126 determines whether an amount of light emitted from the light emitter 88 and then received by the light receiver 90 is less than a predetermined value (i.e., shaded condition). If it is determined that the amount of light received by the light receiver 90 is less than the predetermined value (i.e., shaded condition), meaning that any member exists adjacent to the gap 72, at step S5 the second control 126 energizes the associated cage warning device 58 to provide a necessary warning for the passengers in the cage 26. The warning may be a buzzer, message (e.g., "Please step away from door."), or combination thereof. The warning message may be displayed simultaneously on the display device 60.

If it is determined at step S1 that the cage 26 remains to a halt, the second control 126 determines at step S3 whether the amount of light received by the light receiver 90 is less than the predetermined value. If the determination is affirmative, meaning that any member exists adjacent to the gap 72, at step S4 the second controller 126 transmits a certain signal to the opening/closing control 130 to prohibit the opening operation of the opposing doors 38 and 40. If the shading of the light receiver 90 is occurred during the opening operation of the doors 38 and 40, the opening operation comes to a halt. Then, at step S5 the warning device 58 of the cage 26 is energized to provide a necessary warning to the passengers in the cage 26.

Figure 8:
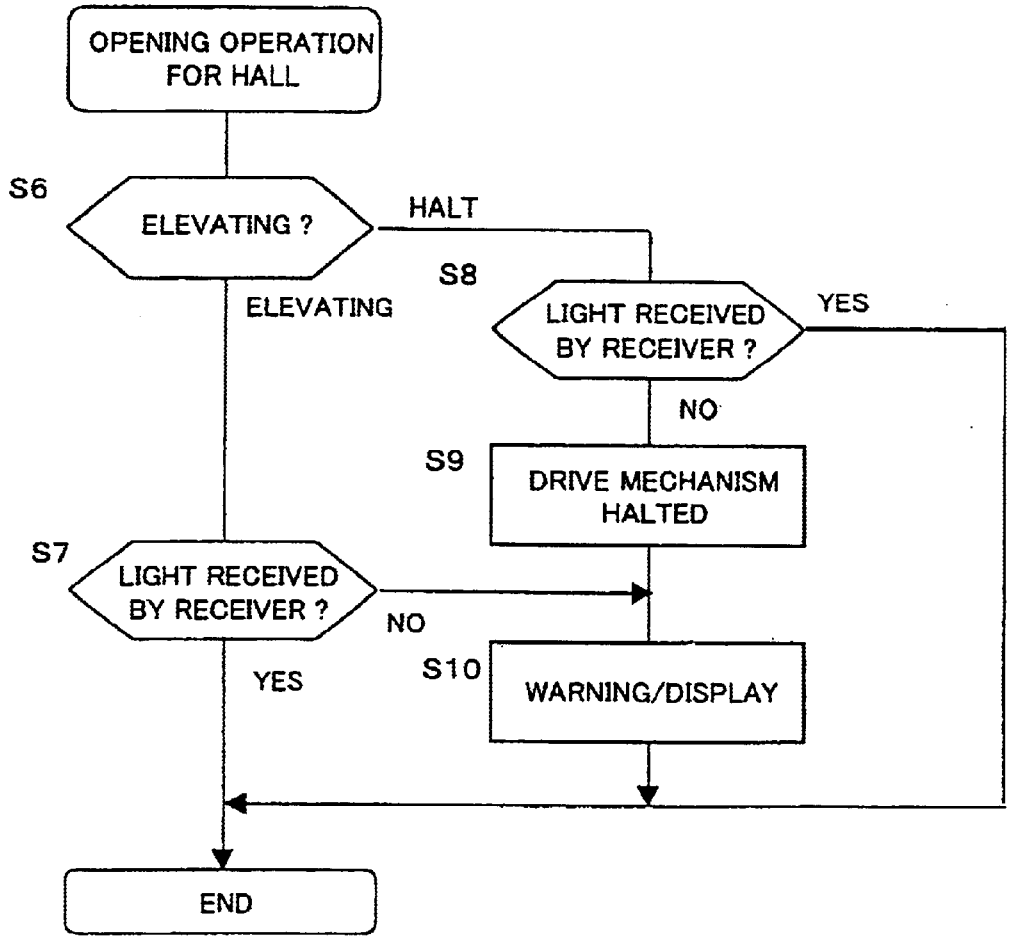
FIG. 8 is a flowchart showing a door opening operation of the safety installation for the hall.

FIG. 8 is a flowchart showing a control operation of the first control 124 for the hall safety installation 114. As can be seen from the drawing, the program flow is similar to that shown in FIG. 6. According to the program, at step S6 the first control 124 determines whether the cage 26 is elevating within the elevator shaft 16. If affirmative, another determination is made at step S7 whether the amount of light emitted from the light emitter 88 and then received by the light receiver 90 is less than the predetermined value (i.e., shaded condition). If also affirmative, i.e., it is detected that any member exists adjacent to the gap 112, at step S10 the first control 124 energizes the associated warning device 102 to provide a necessary warning to the passengers waiting at the hall 32. The content of the warning may be similar to that provided from the warning device 58 of the cage 26.

If the cage 26 is at a halt, the first control 124 determines at step S8 whether light from the hall light emitter 88 is detected by the hall light receiver 90. If the amount of light received by the hall light receiver 90 is less than the predetermined value, i.e., it is determined that any member exists adjacent to the gap 112, the first control 124 prohibits the opening operation of the doors 38 and 40 at step S9, and then energizes the warning device 102 at step S10, providing the necessary warning to the passengers waiting at the hall.

As described above, according to the safety installations 74 (114), if any member existing adjacent to the gap 72 (112) between the door 30 (40) and the neighboring frame defining the door chamber 66 (118) is detected, the opening operation of the door 38 (40) is prohibited to prevent the member from being drawn into the gap 72 (112). Also, even if the cage 26 is in the elevating operation and also the member adjacent to the door 30 (40), if any, is detected, the warning is made to the passengers. This effectively prevents any member from being drawn into the gap 72 (112) at the opening of the door 38 (40).

Although the descriptions have been made to the double-leaf door, the present invention may equally be applied to the single-leaf door.

Second Embodiment

It can be understood that the above-described operation for making a halt of the opening operation of the door 38 and the associated door 40 is so effective in order to ensure the safe transportation of the passengers staying in the cage 26. However, if no passenger is in the cage 26, nothing like clothes of the passenger will be drawn into the gap 72 during the opening of the door 38. Therefore, the control may be designed so that where there is any passenger in the cage 26 the above-described opening operation is performed and where there is no passenger in the cage another operation is carried out.

Figure 9:
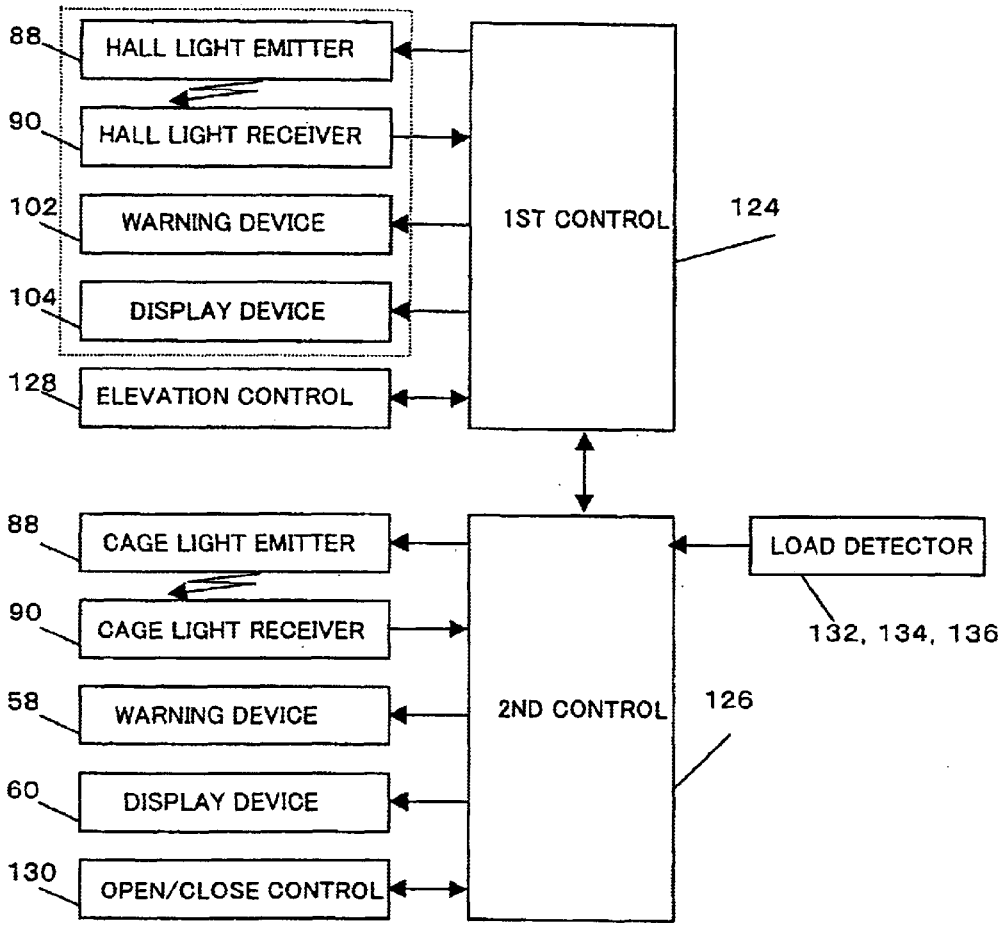
FIG. 9 is a block diagram of another control circuit of the safety installation of the elevator system.

For this purpose, the elevator system 10 includes any means for detecting the existence of the passenger in the cage 26 or any live load such as passenger or passengers. For instance, as shown in FIG. 1, the elevator system 10 includes a load detector 132 of the motor 20, another load detector 134 mounted at a connection between the wire 24 and the cage 26, or another load detector 136 mounted at the connection between the bottom of the cage 26 and the cage frame 28, which is electrically connected with the second control 126 as shown in FIG. 9. Instead of the load detector, as shown in FIG. 2 an image pick-up device 138 such as CCD camera may be provided. In this instance, an image picked up by the imaging device is processed to determine the existence of the passenger in the cage.

Figure 10:
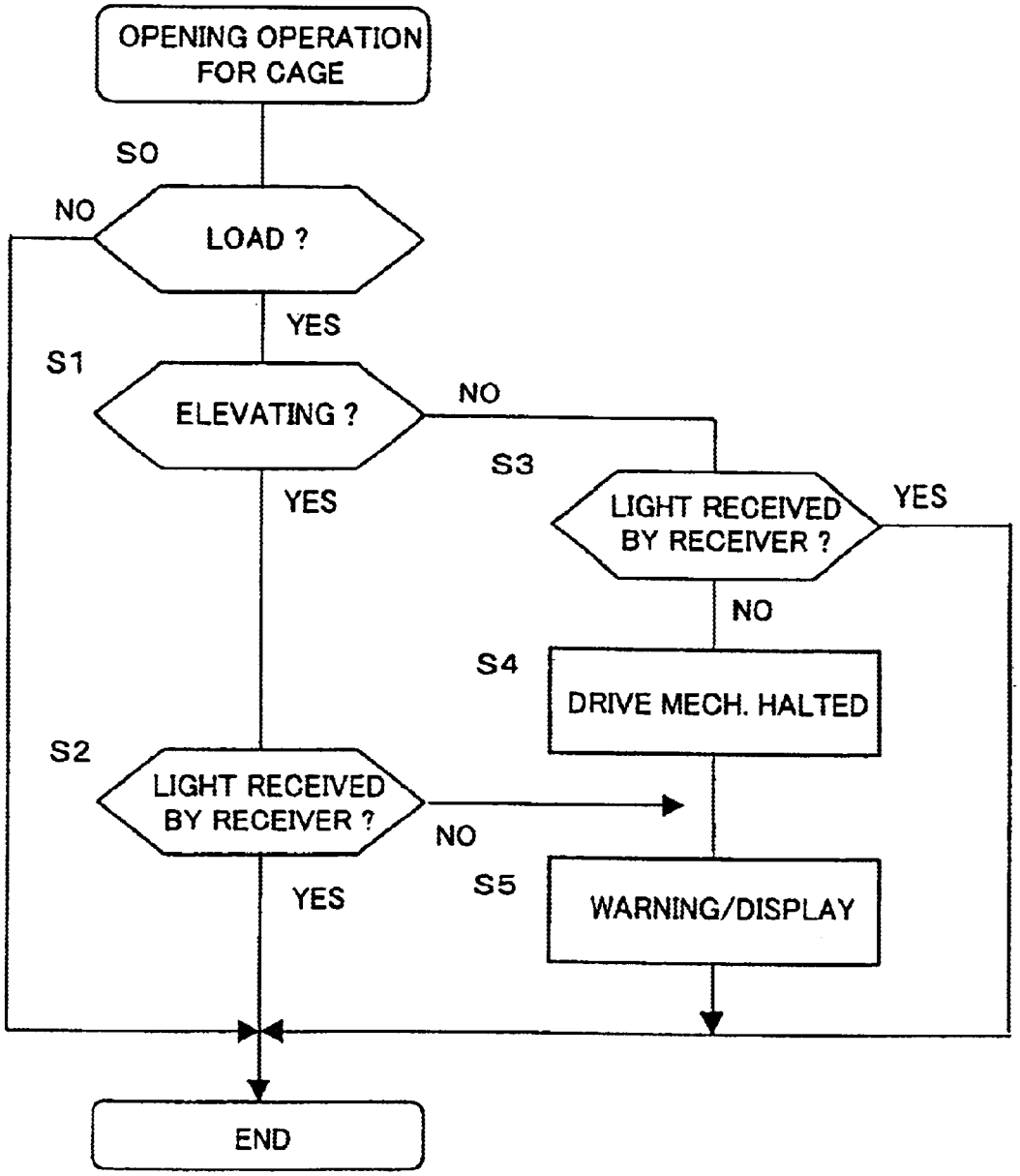
FIG. 10 is a flowchart showing another door opening operation of the safety installation for the cage.

FIG. 10 shows a control of the control circuit with the load detector. According to this control, at step S0 the second control 126 determines the existence of the live load (i.e., the existence of passenger) using the output from the load detector 132, 134 or 136. If no live load is detected, the second control 126 jumps steps S1–S5. On the other hand, if any live load is detected, the door opening operation described above with reference to FIG. 7 is performed.

With the system of the second embodiment so constructed, any failure or malfunction of the light emitter 88 and/or light receiver 90 does not cause an unnecessary halt of the opening operation of the doors

Third Embodiment

Figure 11:
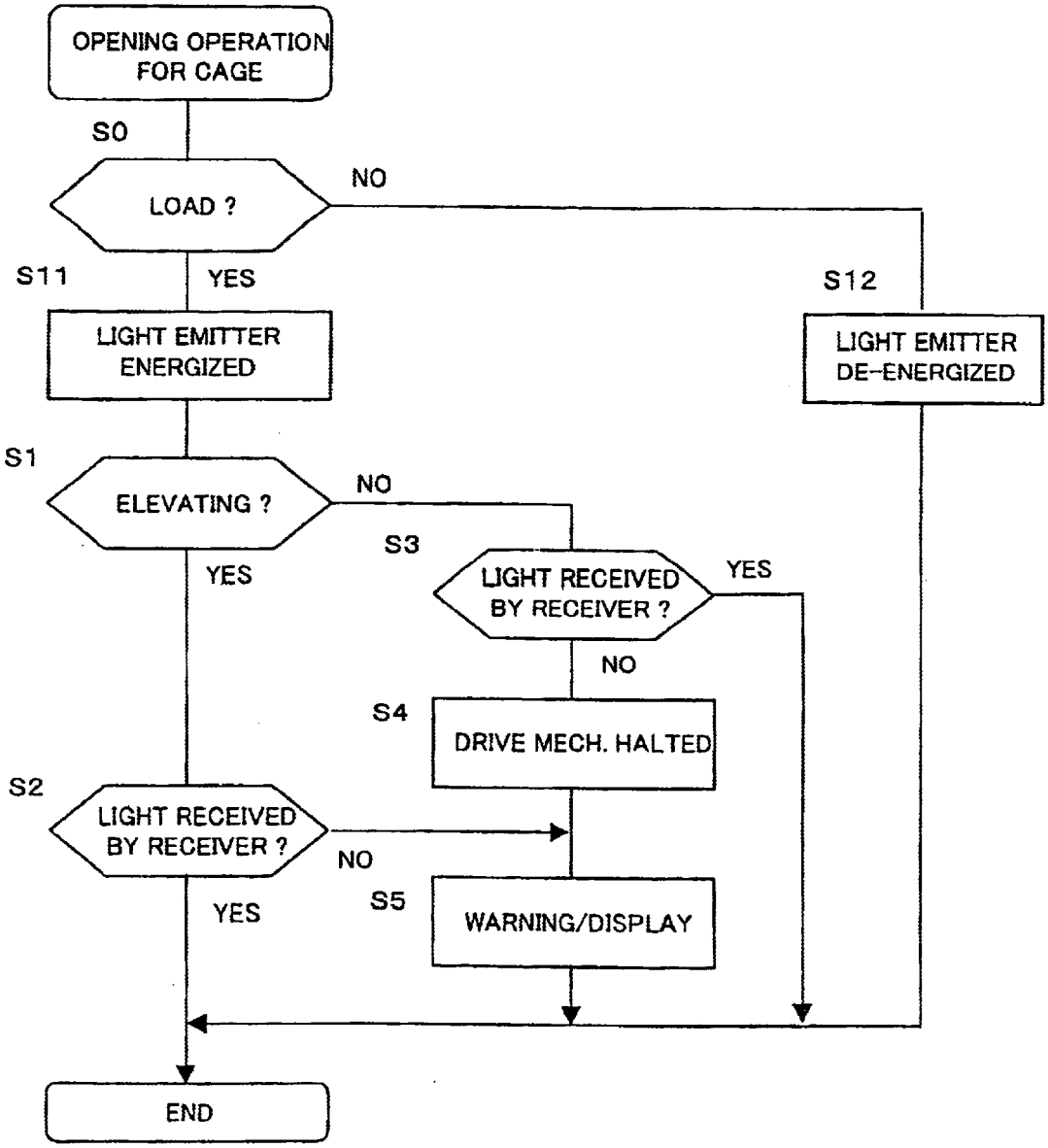
FIG. 11 is a flowchart showing another door opening operation of the safety installation for the hall.

As shown in FIG. 11, the opening operation of the doors with the load detector may be designed so that the light emitter 78 is energized at step S11 only if it is detected at step S0 that there is any passenger in the cage 26. Namely, the light emitter 78 is de-energized at step S11 if it is detected at step S0 that there is no passenger in the cage 26. In this instance, an unnecessary light emission is prevented, which extends a lifetime of the light emitter.

Fourth Embodiment

Figure 12:
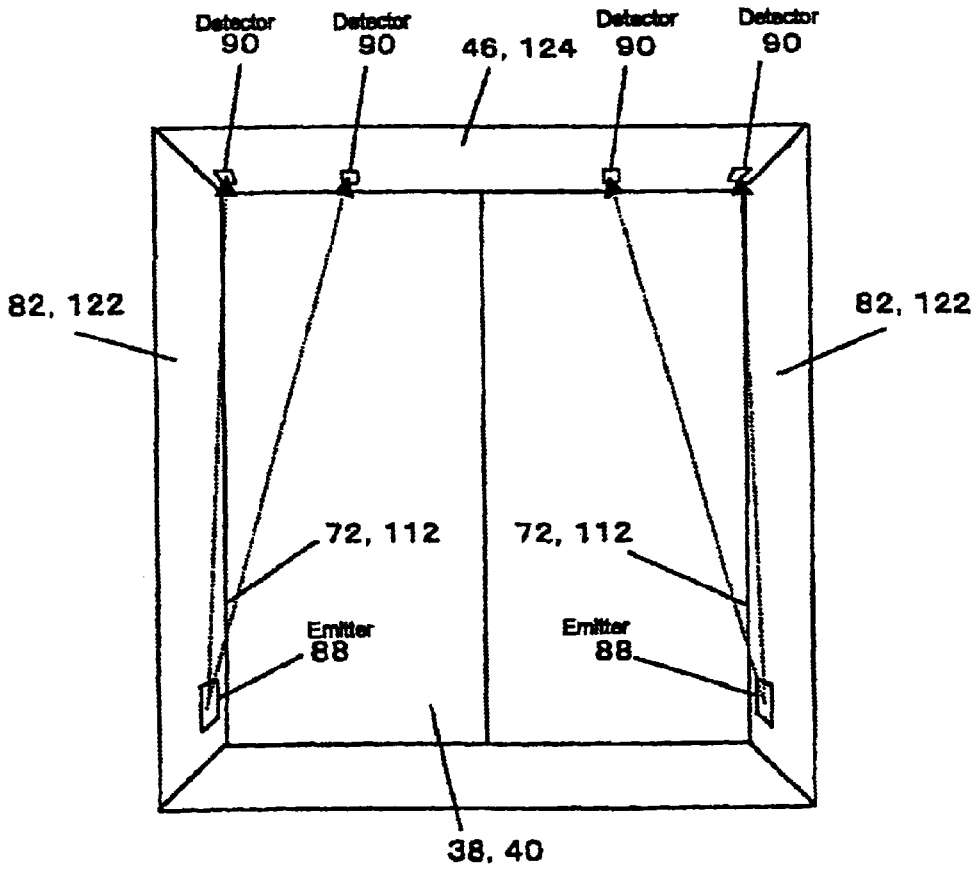
FIG. 12 is a side view of the cage/hall entrance with another arrangement of the light emitters and light receivers.

Although in the safety installations in FIGS. 2 and 3, one light emitter 88 is paired with one light receiver 90, as shown in FIG. 12 a plurality of light receivers 90 may be provided at different positions in the upper horizontal surface leaving different distances from the vertical surface 82, so that light from one light emitter 88 is detected by the plurality of light receivers 90. According to this embodiment, different operations may be made depending upon amounts of light received by the light receivers 90.

Figure 13:
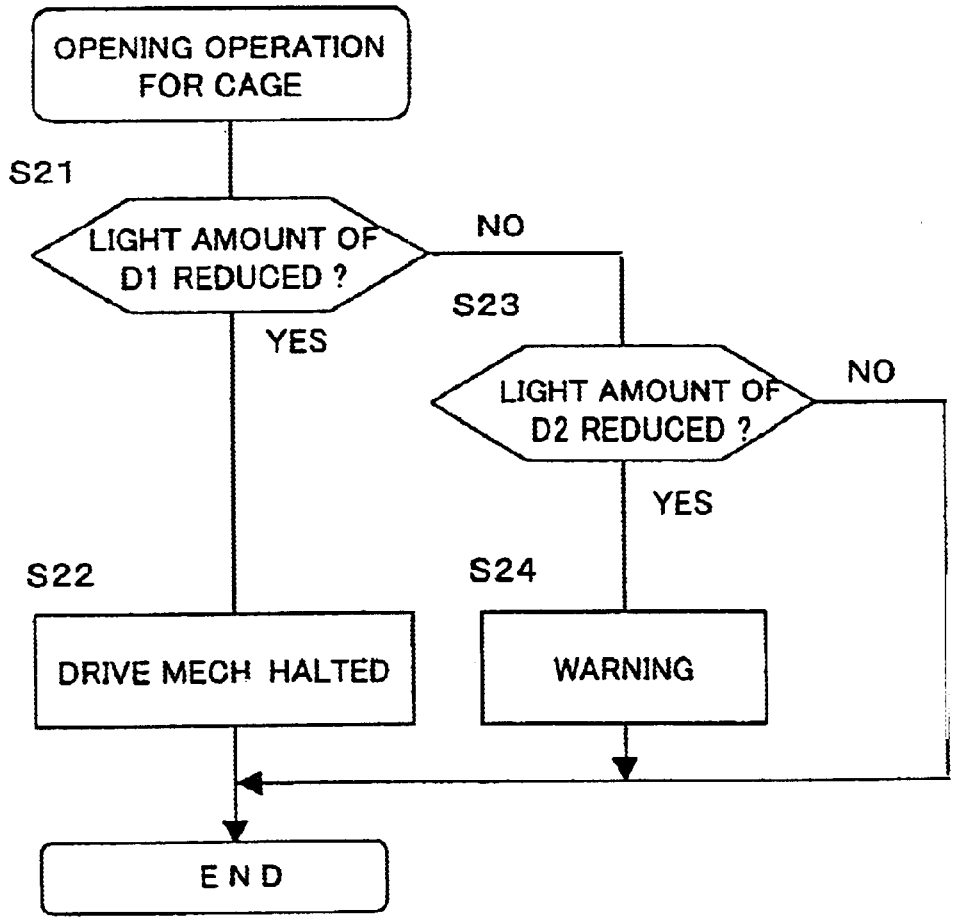
FIG. 13 is a flowchart showing another door opening operation of the safety installation of the elevator system.

For example, as shown in FIG. 13, if the amount of light received by the light receiver 90 (D1) adjacent to the vertical surface 82, 122 is less than the predetermined, reference value, the operation of the door mechanism 70 is prohibited at steps S21 and S22. On the other hand, if the amount of light received only by the light receiver 90 (D2) away from the vertical surface 82, 122 is determined to be less than the predetermined value at step S23, the warning device 58, 102 and/or display device 60, 104 is energized at step S24 to make the necessary warning for the passenger or passengers.

Figure 14:
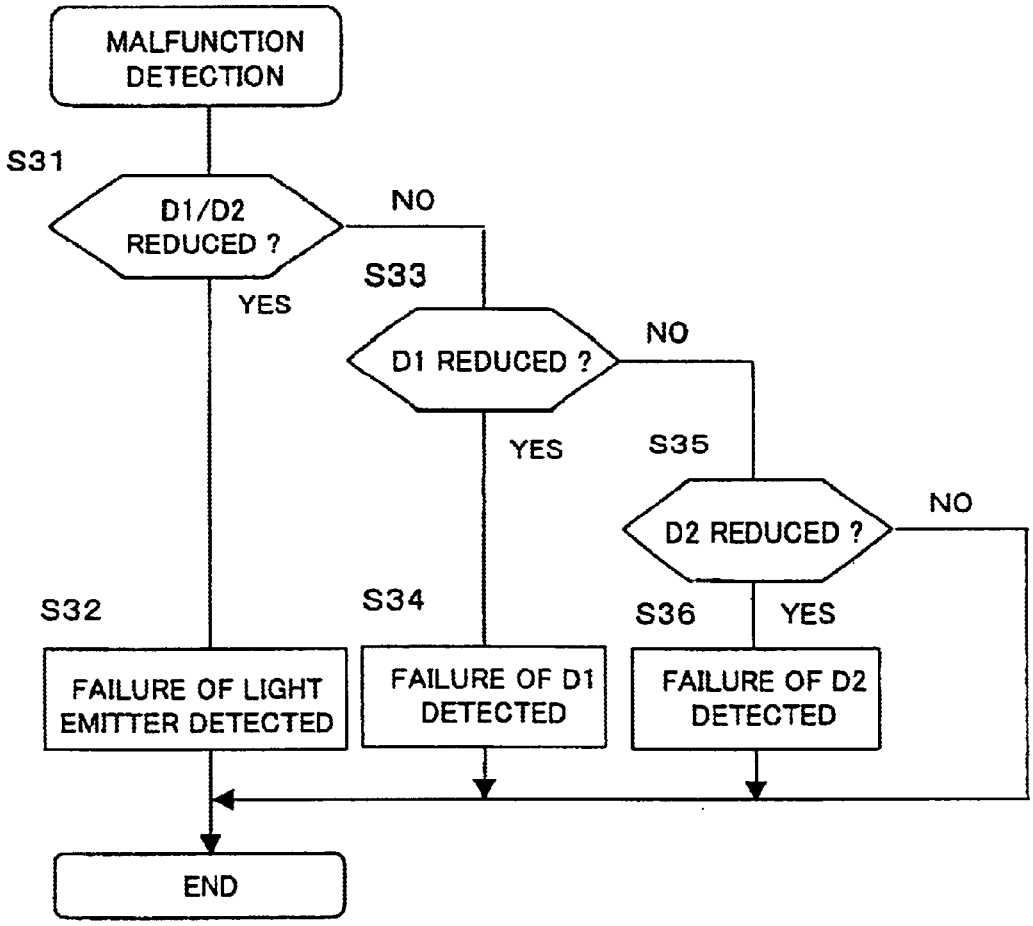
FIG. 14 is a flowchart showing an operation for detecting malfunctions of the light emitters and light receivers.

As shown in FIG. 14, the control may be designed so that amounts of light received by the two light receivers 90 (D1, D2) are compared with respective references at step S31. In this instance, if both amounts of light received by the receivers 90 are less than the predetermined values, it is determined that the light emitter 88 is in a malfunction state. Also, if either of the light amounts is less than the its predetermined value, it is determined that the corresponding light emitter 90 (D1 or D2) is in the malfunction state. Further, according to the determination, the warning devices 58 and 102 and display devices 60 and 104 are energized to make a warning.

The operations described with reference to FIG. 14 may be made only when the load detected by the load detector 132, for example, is less than the predetermined, reference value which means that no passenger exists in the cage.

Fifth Embodiment

Figure 15:
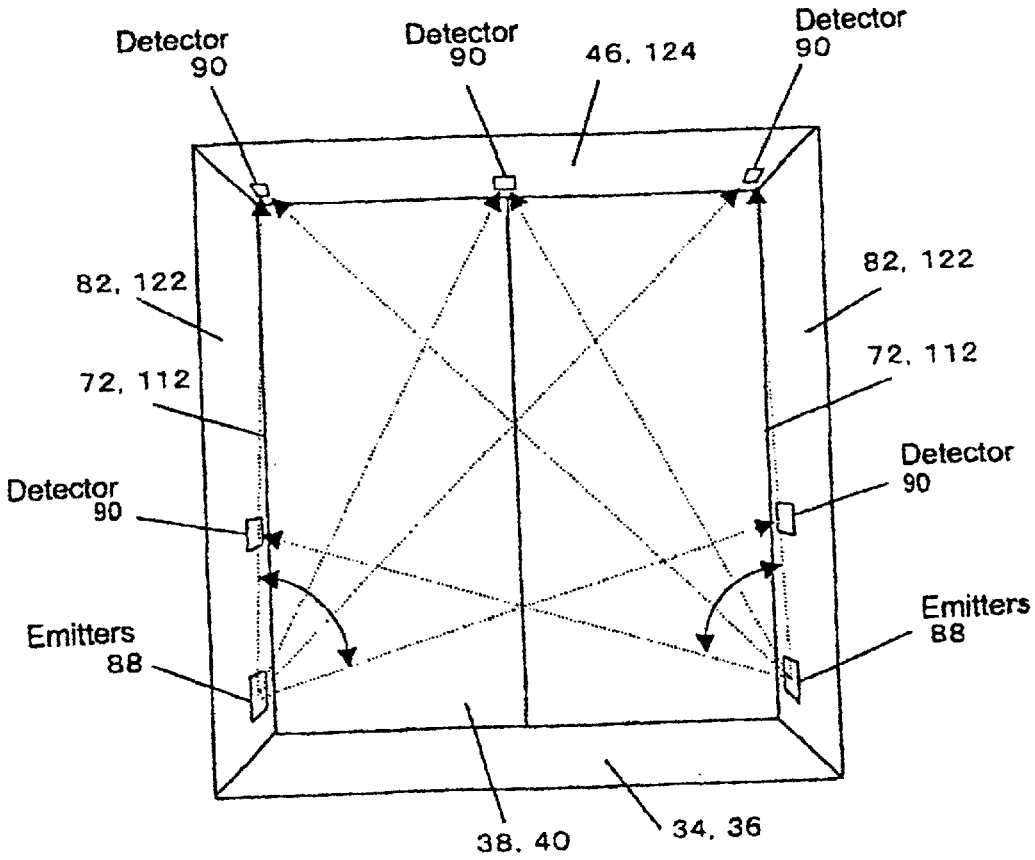
FIG. 15 is a side view of the cage/hall entrance with another arrangement of the light emitters and light receivers.

As shown in FIG. 15, the light receiver 90 may be provided at three portions, i.e., opposite end portions and mid-portion, of the upper horizontal surface 46 (124). In this instance, the right and left light emitters 88 alternately emit a flux of light extending in a sector zone covering three light receivers for detecting any member in the doorway 34 (36) and adjacent to the gaps 72 (112). Also, as shown in the drawing, the light receiver 90 may be provided in the vertical surface 82 (122) so that light from the light emitter 88 provided on one vertical surface is received by the light receiver provided on the opposite vertical surface. As described above, the use of the plural light receivers 90 allows any member not only adjacent to the gaps 72 (112) but also adjacent to the doors 38 (40) to be detected effectively. In particular, the light receiver 90 mounted in the vertical surface 82, 122 causes the safety installation to detect any member in a lower position and thereby to prevent the same from being drawn into the gaps.

The light from the left and right light emitters 88 is not required to be the sector beam. Also, another light emitter capable of changing a direction of light to be emitted can be used instead, which will be described below.

The failure or malfunction of the light emitters 88 and light receivers 90 may be performed using the operation shown in FIG. 14. Also, according to this embodiment, a reduction of light emitted from the light emitters 88 can be detected by comparing amounts of light emitted from opposite light emitters 88 and then received by three light receivers 90 provided in the upper horizontal surface 46.

Sixth Embodiment

Figure 16:
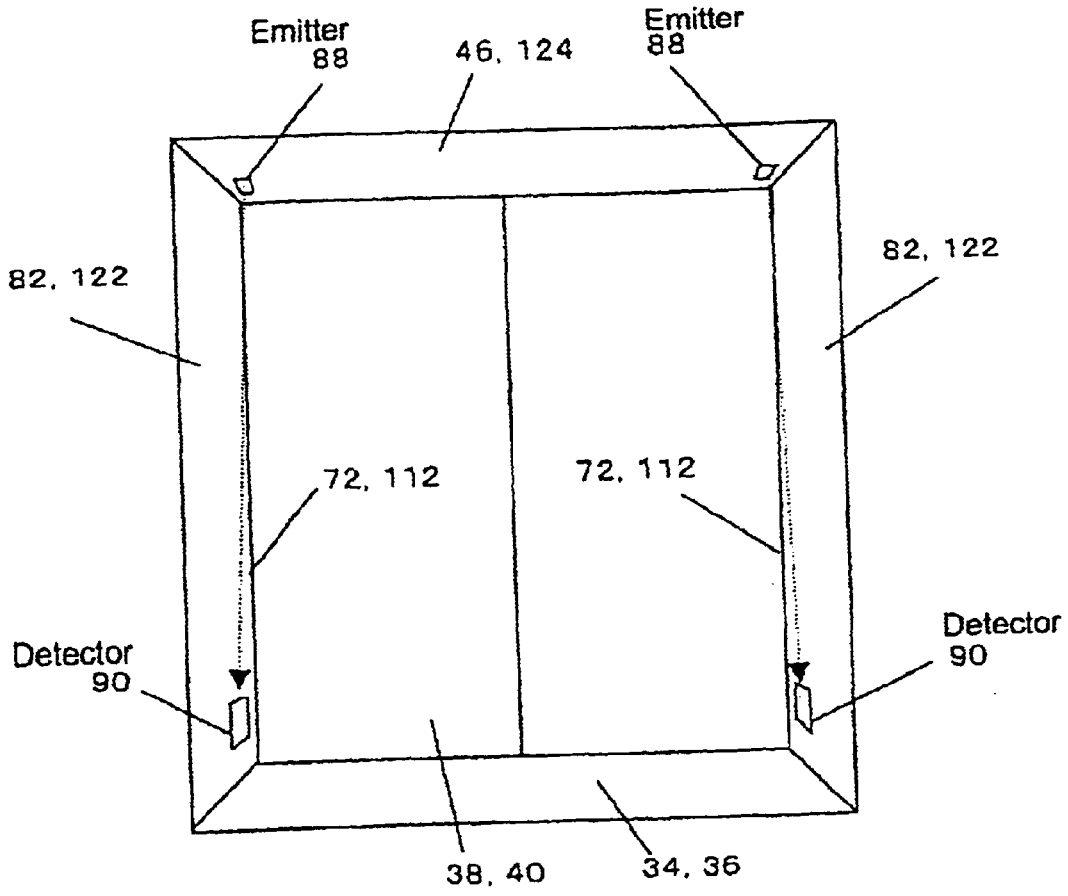
FIG. 16 is a side view of the cage/hall entrance with another arrangement of the light emitters and light receivers.
Figure 17:
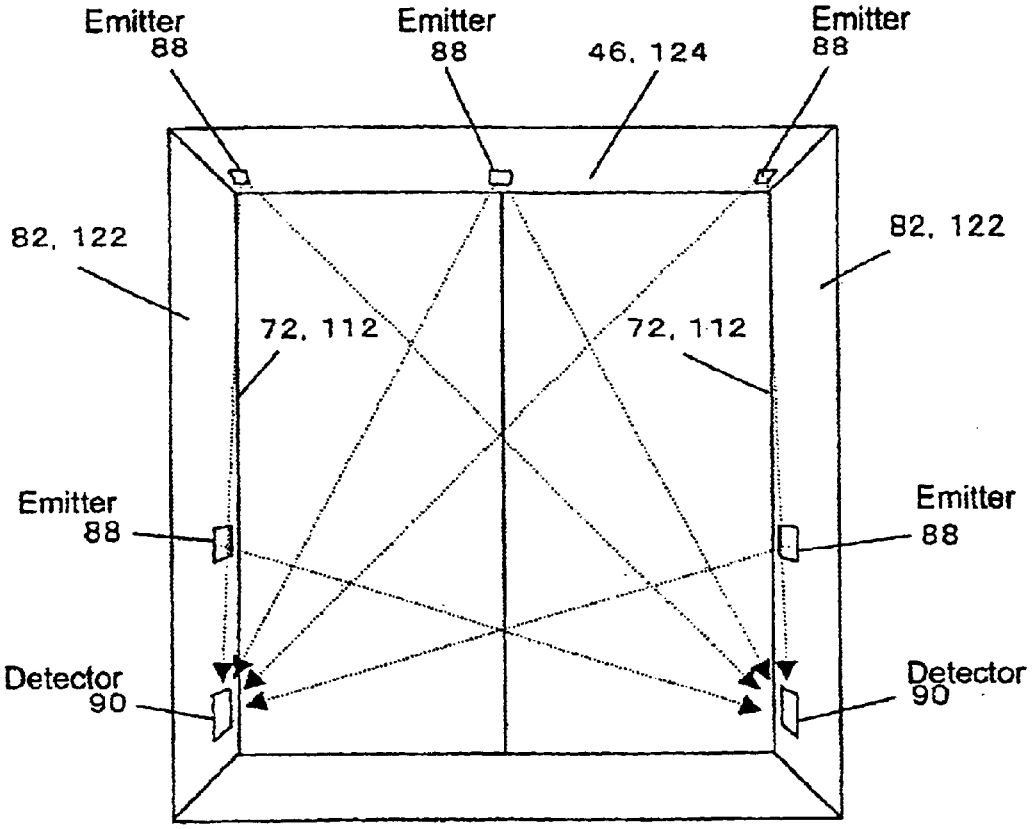
FIG. 17 is a side view of the cage/hall entrance with another arrangement of the light emitters and light receivers.
Figure 18:
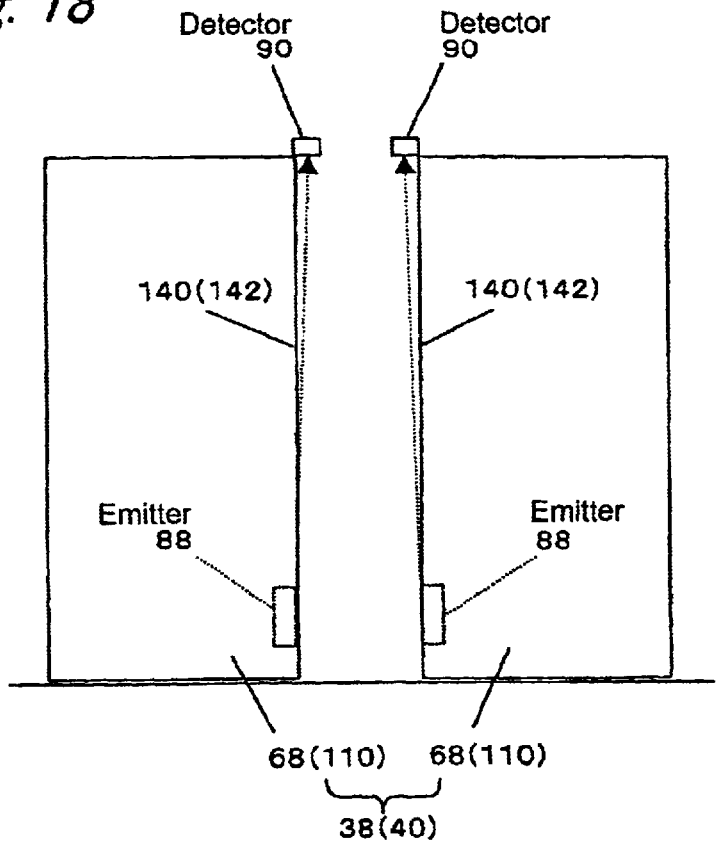
FIG. 18 is a side elevation view of the double-leaf door, showing the arrangement of the light emitters and receivers.
Figure 19:
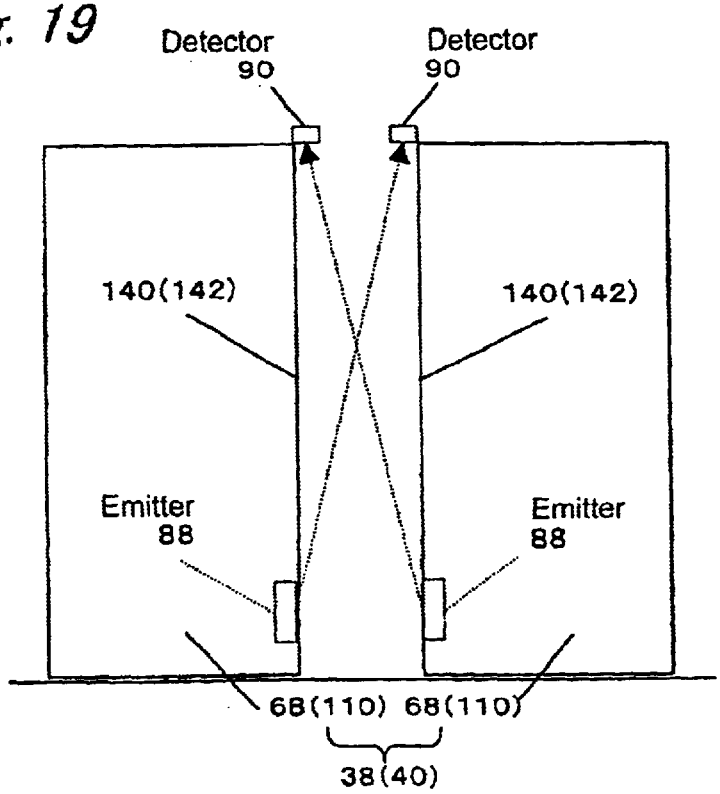
FIG. 19 is a side elevation view of the double-leaf door, showing another arrangement of the light emitters and receivers.

Although the light emitter 88 is provided in the vertical surfaces 82 (122) and the light receiver 90 is provided above the light emitter 88, as shown in FIGS. 16 and 17 it may be designed that the light receiver 90 is provided in the vertical surfaces 82 (122) and the light emitter 88 are provided in the upper horizontal surface 46 (124).

Seventh Embodiment

Although the light emitter and receiver are positioned in a vertical plane extending across the opening defined between the fixed vertical frames, the light emitter and receiver may be provided in a vertical plane extending across an opening defined between the vertical leading end surface of the door leaf and another vertical surface opposing thereto. The another vertical surface may be the other door leaf of the double-leaf door, which cooperates with the leading end surface of one door leaf to open and close the doorway. Alternatively, the another vertical surface may be a fixed wall if the door is a single-leaf door.

For example, in the embodiments shown in FIGS. 18 to 21 the light emitter 88 is provided on the opposing, leading end vertical surfaces 140, 142 of the door leaves 68 and 110 of the double-leaf door. The light receivers 90 are fixed on the top portion 140 of the door and projected a certain distance from the vertical end toward the opposite door leaf, so that light from the light emitter 88 is detected by the light receivers 90 provided on the same door leaf 68 (110) (see FIG. 18) or provided on the opposite door leaf (see FIG. 19). Any member located between the opposing door leaves 68 (110) reduces an amount of light to be received by the light receiver, which causes the controller to detect the existence of the member.

Figure 20:
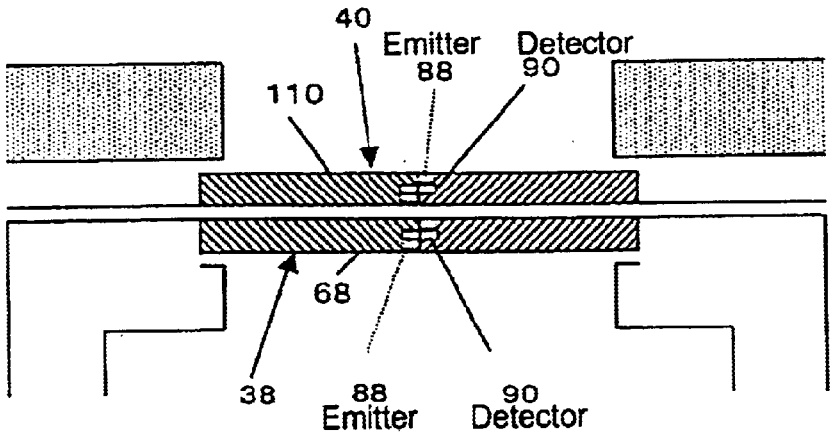
FIG. 20 is a horizontal cross section view of the cage and hall door in which the doors are closed, showing an arrangement of the light emitters and receivers.
Figure 21:
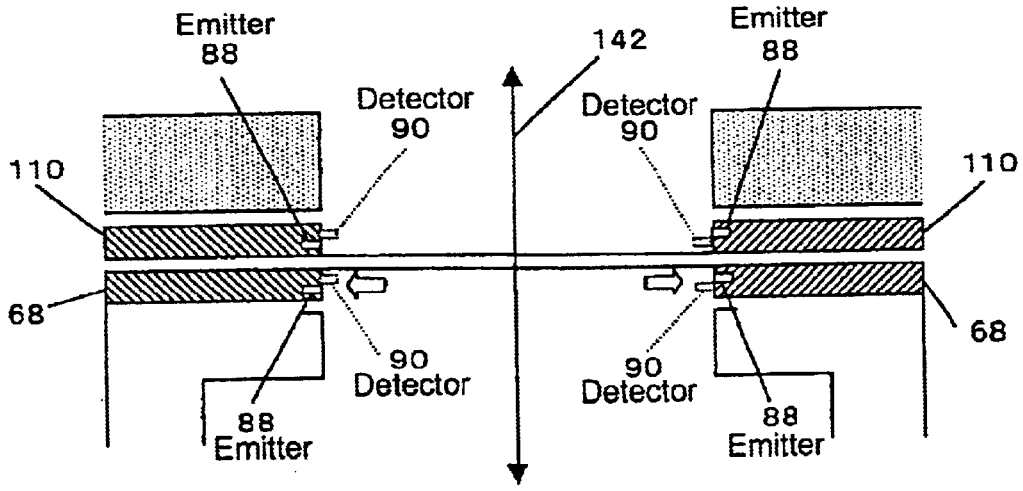
FIG. 21 is a horizontal cross section view of the cage and hall door in which the doors are opened, showing an arrangement of the light emitters and receivers.

It should be noted that as best shown in FIGS. 20 and 21 the light receivers 90 provided on the door leaves 68 (110)

are offset in a direction perpendicular to the door movement (in FIG. 21, indicated by reference numeral 142) to prevent the mutual contact with each other at the closing of the door.

In this embodiment, the light emitter 88 is provided on the leading end surface 140 (142) of the door leaf and the light receiver 90 is provided thereabove, the light receiver 90 may be provided in the leading end surface 140 (142) and the light emitter 88 is provided thereabove.

Eighth Embodiment

Figure 22:
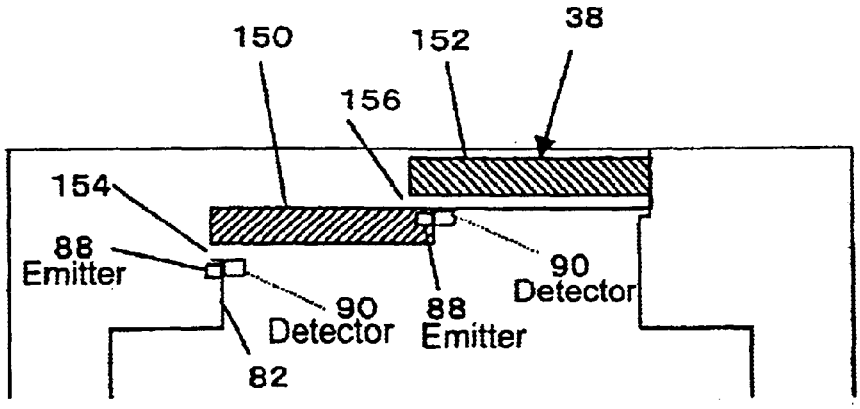
FIG. 22 is a side elevation view of another double-leaf door in which the doors are closed, showing the arrangement of the light emitters and receivers.
Figure 23:
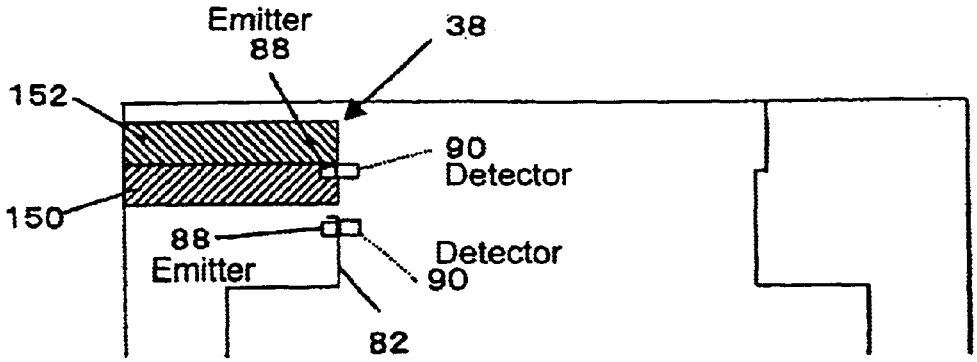
FIG. 23 is a side elevation view of another double-leaf door in which the doors are opened, showing the arrangement of the light emitters and receivers.

Although several embodiments have been described above, in each of which the safety installation is applied to the double-leaf door, as best shown in FIGS. 22 and 23 the present invention is equally applied for another elevator system in which the door 38 has a first door leaf or portion (low velocity door leaf) 150 and a second door leaf or portion (high velocity door leaf) 152. As can be seen for those skilled in the art, according to this door installation the second door leaf moves with the first door leaf and also relative to the first door leaf in the direction in which the first door leaf moves.

Also, in this instance, for the purpose of preventing any member from being drawn into a gap 154 defined between the fist door leaf 150 and the vertical frame 42, preferably one of the light emitter 88 and the light receiver 90 is provided at a certain position of the vertical surface 82 adjacent to its lowermost end and the other is provided at a certain position of the upper horizontal surface adjacent to the topmost end of the vertical surface 82.

Further, for the purpose of preventing any member from being drawn into another gap 156 defined between the first and second door leaves 150 and 152, one of the light emitter 88 and the light receiver 90 is provided in the leading, vertical end surface of the first door leaf 150 and adjacent to the lowermost end thereof and the other is provided at the top end of the same vertical end surface. Likewise, the same structure may be provided to each hall door 60.

Ninth Embodiment

Figure 24:
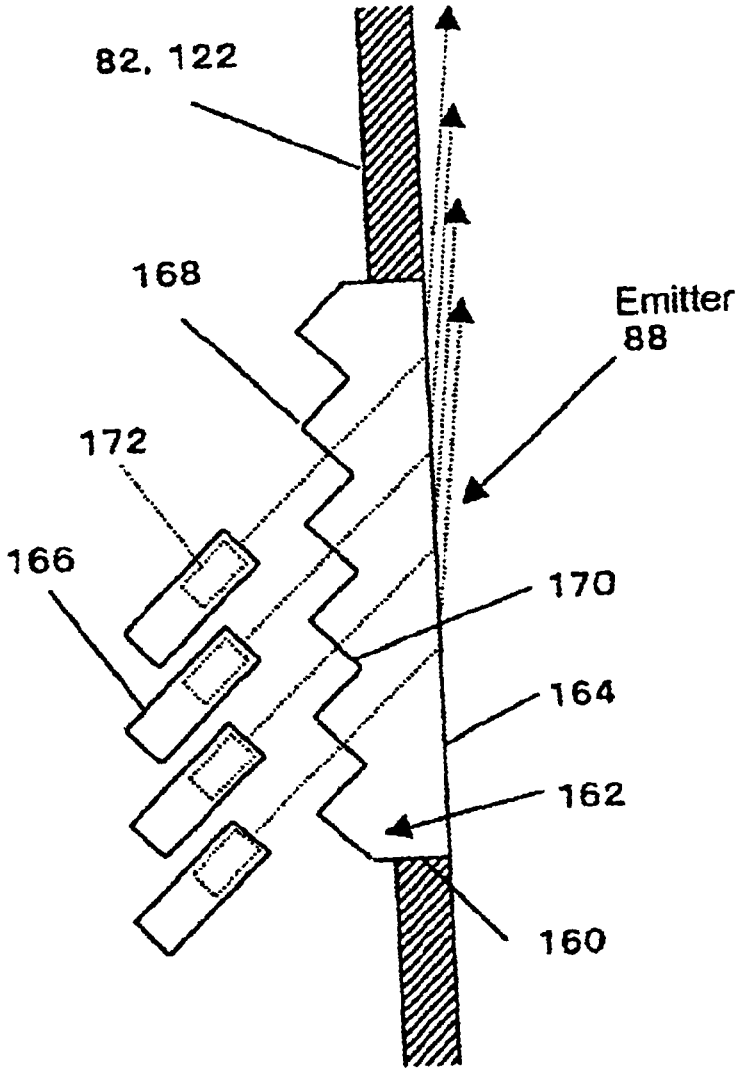
FIG. 24 is an elevation view of the light emitter used in the safety device of the elevator system.

FIG. 24 shows a specific structure of the light emitter 88 suitably mounted in the vertical surface 82 (122). As shown in the drawing, the light emitter 88 has a transparent plate 162 mounted in an opening 160 defined in the vertical surface 82 (122). One major surface 164 or outer surface of the transparent plate 162, through which light is emitted therefrom into the entrance opening, is substantially flush with the vertical surface 82. Light sources 166 are provided behind the transparent plate 162. Various commercially available light sources such as diode or semiconductor laser are used for the light source 166.

Each light source 166 is inclined to the transparent plate 162 so that light emitted from the light source 166 is directed obliquely, i.e., upwardly in the drawing. In order to reduce the reflection of light from the transparent plate 162, the second major surface or incident surface 168 adjacent to the light sources 166 is stepped and inclined so that light emitted from each light source 166 enters the transparent plate 162 perpendicularly through the corresponding inclined surface portion of the transparent plate.

According to the light emitter 88, light emitted from each light source 166 is transmitted through the corresponding stepped surface portion 168 into the transparent plate 162 and then through the outer surface 164. The light outgoing from the transparent plate 162 refracts at the boundary surface and then travels toward the light receiver provided above the light emitter 88 in the vicinity of the vertical surface 82 (122).

In order to prevent any member from being drawn into the gap between the door and the adjacent frame, preferably the light pass positions as close to the gap as possible. For this purpose, preferably the positions of the outer surface 164 of the transparent plate 162 and the light sources 166 are determined so that an incident angle of light into the boundary of transparent plate 162 and air, i.e., outer surface of the transparent plate 162, is slightly less than the critical angle.

Also, in order to detect whether each light source 166 works normally, another light receiver 172 is provided beside the light source 166 for detecting an amount of light to be emitted from the light source 166. In this instance, if the amount of detected light is less than the predetermined value, it is determined that the light source 166 is in the malfunction state.

Tenth Embodiment

Figure 25:
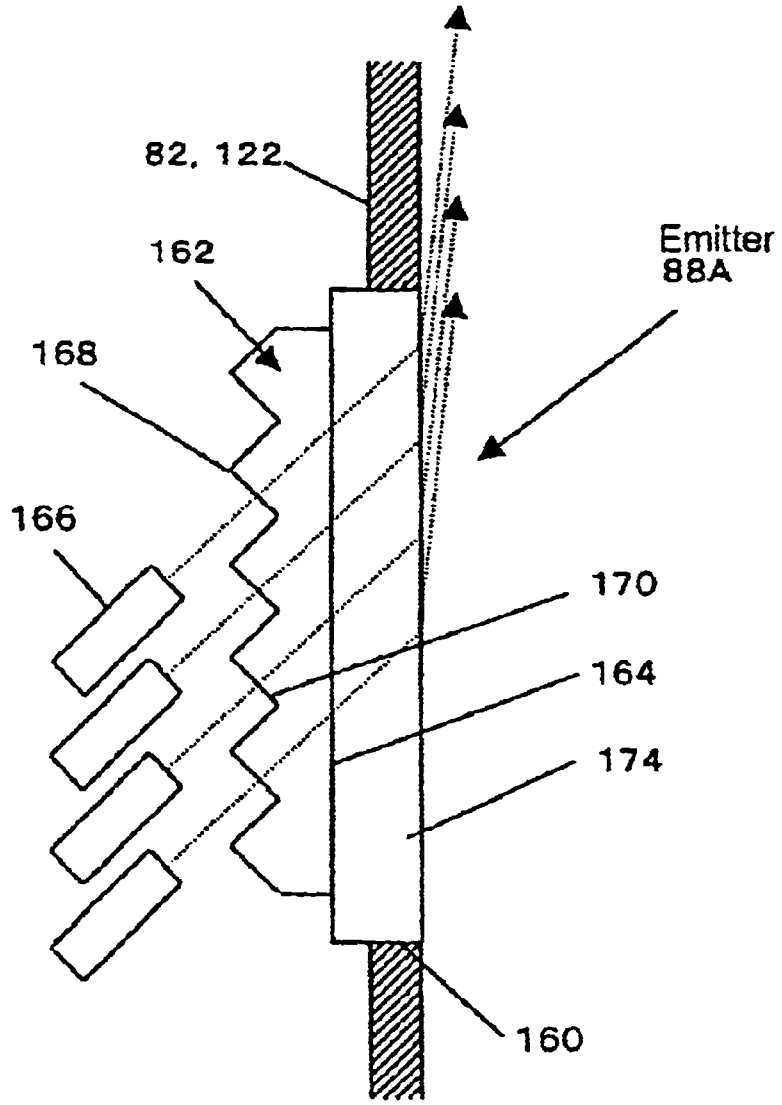
FIG. 25 is an elevation view of another light emitter used in the safety device of the elevator system.

FIG. 25 shows another embodiment of the light emitter. In this embodiment, the light emitter 88A has a second transparent plate 174 mounted in an opening 160 defined in the vertical wall 82 (122). Provided behind the transparent plate 174 is the stepped transparent plate 162 described above, which is adhered to the second transparent plate 174 by a suitable material such as adhesive.

Eleventh Embodiment

Figure 26:
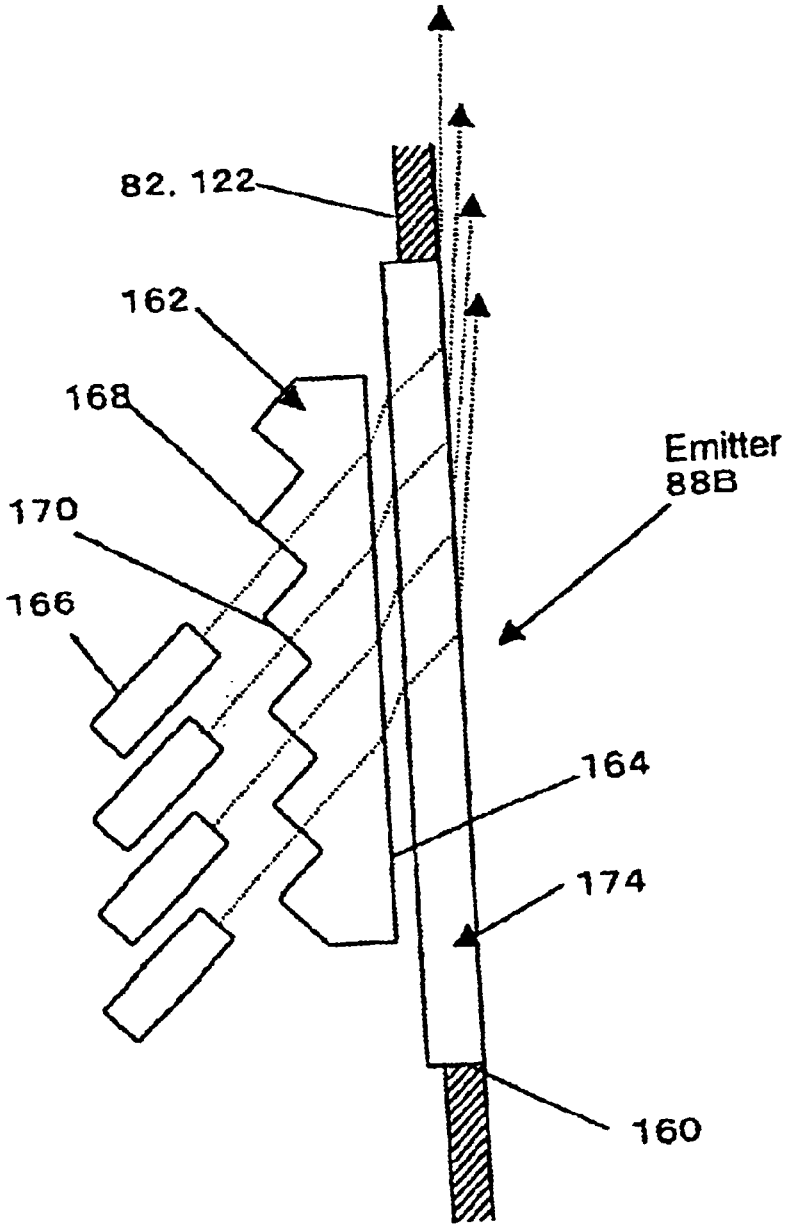
FIG. 26 is an elevation view of another light emitter used in the safety device of the elevator system.

It is not necessary to arrange two transparent plates 162 and 174 in close contact with each other and, as shown in FIG. 26 illustrating another embodiment of the light emitter 88, they may be separated from the other.

Twelvth Embodiment

Figure 27:
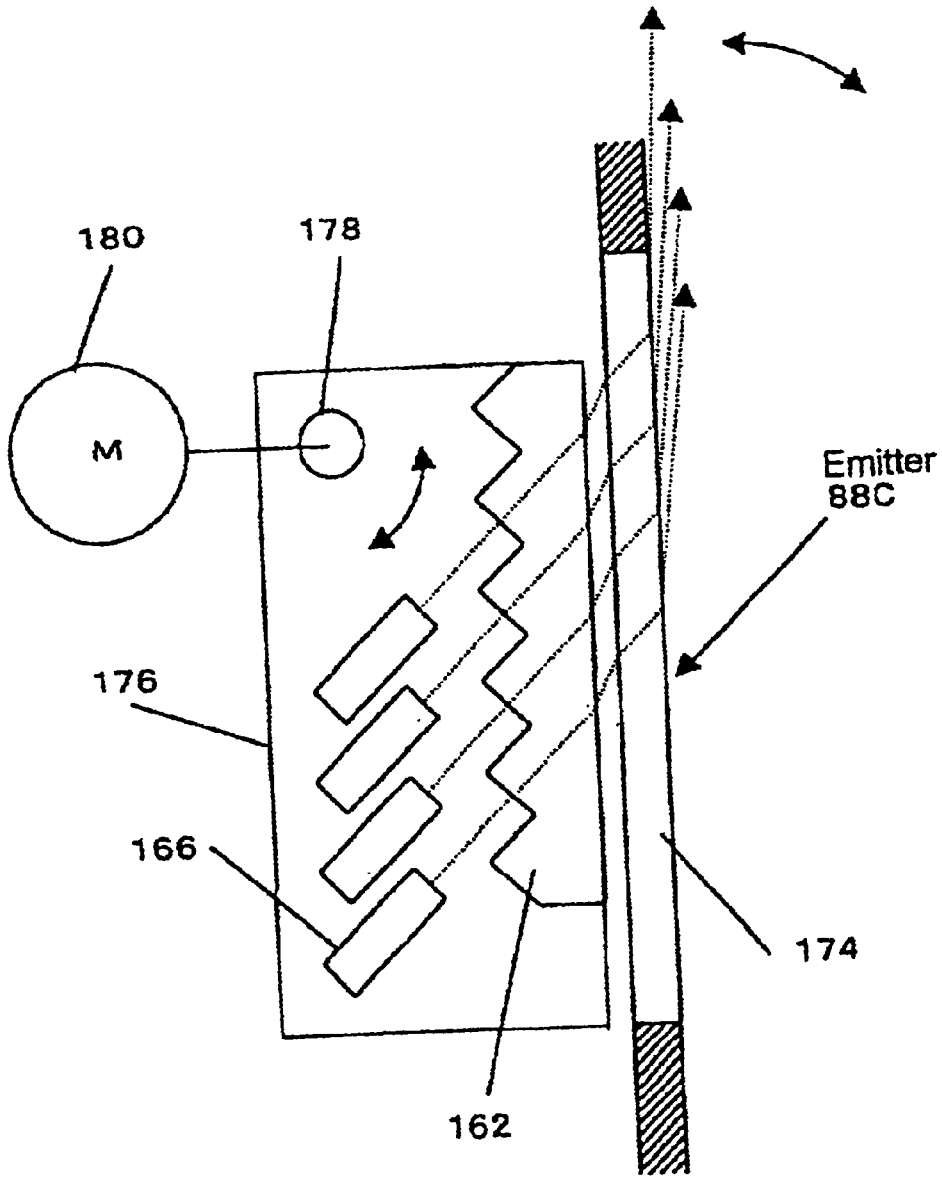
FIG. 27 is an elevation view of another light emitter used in the safety device of the elevator system.

The transparent plate 162 and the light sources 166 may be fixed separately or may be fixed on the same support member 176 as shown in the light emitter 88C in FIG. 27. In this instance, preferably the support member 176 is rotatably supported by a shaft 178 extending parallel to the access direction 142 (see FIG. 21) of the doorway. Also, a DC motor 180 is connected to the shaft 178 to change a direction along which light is emitted from the transparent plate 174.

Thirteenth Embodiment

Figure 28:
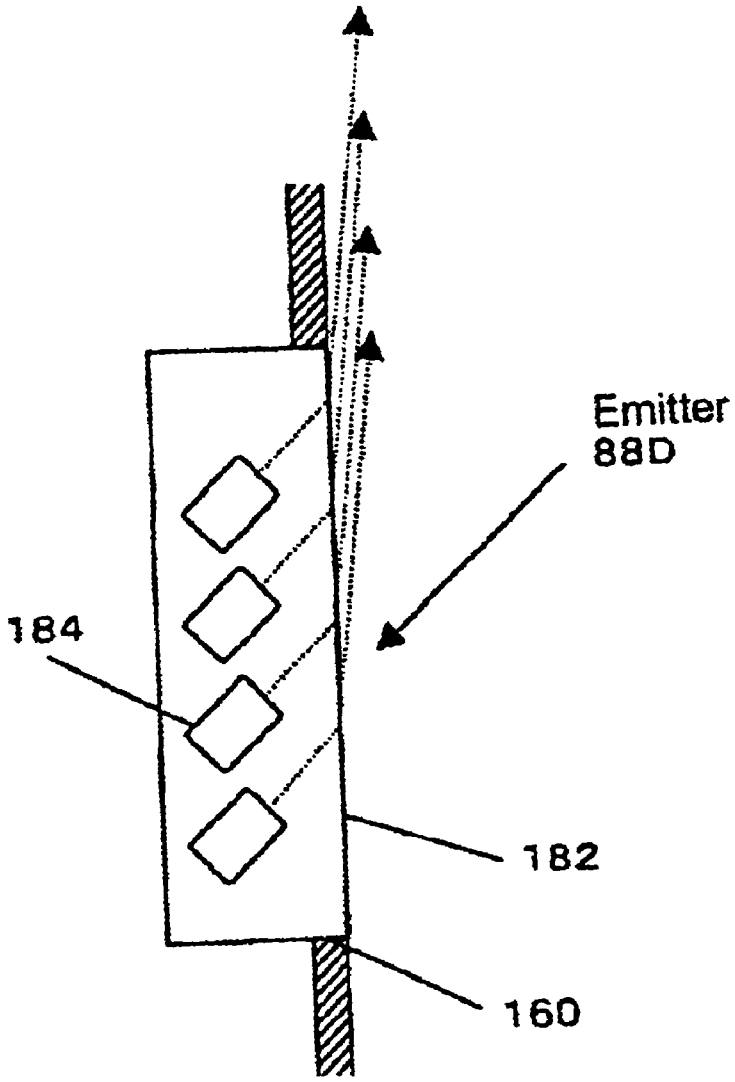
FIG. 28 is an elevation view of another light emitter used in the safety device of the elevator system.

As shown in FIG. 28 illustrating another embodiment of the light emitter 88D, the light sources 184 may be encapsulated in the transparent plate 182 mounted in the opening 160.

Although the present invention has been fully described with the embodiments in which the safety installation is incorporated in the elevator system, it may be applied equally to various openings each equipped with door or doors.

As described above, according to the elevator system of the present invention, nothing will be drawn into gaps between the door and the neighboring vertical frame or another door, which is so safe to the passengers.

What is claimed is:

1. An elevator system having a pair of horizontally opposed vertical frame portions, upper and lower vertically opposed horizontal frame portions connecting uppermost lowermost ends of the vertical frame portions respectively, the opposed vertical and horizontal frame portions defining an opening therein, and a slide door moving horizontally to open and close the opening, comprising:

a first optical device having a light emitter for emitting light and a second optical device having a light detector for detecting the light emitted from the light emitter, wherein one of the first and second optical devices is positioned in one of the opposed vertical frame portions and the other of the first and second optical devices is positioned in the upper horizontal frame portion and adjacent to the one vertical frame portion, so that light from the first optical device travels toward second optical device along a gap defined between the slide door and the one vertical frame portion.

2. The elevator system of claim 1, wherein one optical device is mounted substantially flush with vertical frame portion so that it does not protrude from the one vertical frame portion.

3. The elevator system of claim 1, further comprising:

a drive mechanism for moving the slide door between a closed position in which the slide door closes the opening and an open position in which the slide door opens the opening; and a controller for prohibiting a drive mechanism when an amount of light detected by the light detector during a movement of the door from the closed position toward the open position is less than the predetermined value.

4. The elevator system of claim 3, wherein the second optical device has a second light detector, each of the first and second light detectors being spaced a certain horizontal distance from the first optical device, horizontal distance for the first light detector being different from that for the second light detector.

5. The elevator system of claim 4, wherein the controller determines whether an amount of light detected by each of the first and second light detectors is less than the predetermined value and then specifically operates depending upon whether the amount of light detected by the first light detector is less than the predetermined value or the amount of light detected by the second light detector is less than the predetermined values.

6. The elevator system of claim 4, wherein first and second light detectors are arranged so that the horizontal distance between the first light detector and the light emitter is less than that between the second light detector and the light emitter, and the controller prohibits the driving of the drive mechanism when the amount of light detected by the first light detector is less than the predetermined value.

7. The elevator system of claim 1, further comprising:

a warning device;

a drive mechanism for moving the door between a closed position in which the door closes the opening and an open position in which the door opens the opening; and a controller for driving the warning device when an amount of light detected by the light detector during a movement of the door from the closed position toward open position is less than a predetermined value.

8. The elevator system of claim 1, wherein the first optical device has a second light emitter has a light source for emitting the light and a transparent plate through which the light is transmitted into the opening.

9. The elevator system of claim 1, wherein the first optical device has a second light emitter, and wherein, if both of the amounts of light emitted from the first and second light emitters and then detected by the light detector are less than the predetermined value, the controller determines that the light detector is malfunctioning, and if the amount of light emitted from one of the first and second light emitters and then detected by the light detector is less than the predetermined value, the controller determines that the one light emitter is malfunctioning.

10. The elevator system of claim 1, wherein the second optical device has a second light detector, and wherein, if both of the amounts of light detected by the first and second light detectors are less than the predetermined value, the controller determines that the light emitter is malfunctioning, and if the amount of light detected by one of the first and second light detectors is less than the predetermined value, the controller determines that the one light detector is malfunctioning.

11. The elevator system of claim 1, further comprising:

a load detector for detecting a live load on the elevator cage; and means for driving the warning device when the live load detected by the load detector is greater than a certain value and the amount of light detected by the light detector during a movement of the door from the closed position toward the open position is less than the predetermined value.

12. The elevator system of claim 1, wherein the opening is an opening defined at a hall in a building.

* * * * *